US007121989B2

(12) United States Patent
Kerry

(10) Patent No.: US 7,121,989 B2
(45) Date of Patent: Oct. 17, 2006

(54) ABDOMINAL EXERCISE DEVICE FOR INVERTED ABDOMINAL EXERCISES

(75) Inventor: Ken Kerry, Santa Ana, CA (US)

(73) Assignee: Kerry Magyari, LLC, Santa Ana, CA (US)

( * ) Notice: Subject to any disclaimer, the term of this patent is extended or adjusted under 35 U.S.C. 154(b) by 0 days.

(21) Appl. No.: 10/876,227

(22) Filed: Jun. 24, 2004

(65) Prior Publication Data

US 2004/0242389 A1 Dec. 2, 2004

(51) Int. Cl.
*A63B 26/00* (2006.01)
*A63B 71/00* (2006.01)

(52) U.S. Cl. ..... 482/140; 482/91; 482/907; 21/687

(58) Field of Classification Search ..... 602/36; D21/687–690
See application file for complete search history.

(56) References Cited

U.S. PATENT DOCUMENTS

| | | | | | |
|---|---|---|---|---|---|
| 1,582,487 | A * | 4/1926 | Shank | 482/130 |
| 2,928,675 | A * | 3/1960 | Jozef | 482/133 |
| 3,399,888 | A | 9/1968 | Jensen | 272/81 |
| 3,455,295 | A * | 7/1969 | Kellogg | 601/26 |
| 3,612,042 | A * | 10/1971 | Fry | 601/24 |
| 4,519,605 | A * | 5/1985 | Leland | 482/92 |
| 4,634,118 | A * | 1/1987 | Jensen | 482/94 |
| 4,686,727 | A * | 8/1987 | Wilkinson | 5/503.1 |
| 5,031,605 | A * | 7/1991 | Mills | 602/36 |
| 5,050,871 | A * | 9/1991 | Douglas et al. | 482/110 |
| 5,772,563 | A | 6/1998 | Lin | 482/140 |
| 5,779,607 | A | 7/1998 | Harris | 482/140 |
| 5,853,357 | A | 12/1998 | Jones, Jr. | 482/140 |
| 5,882,284 | A | 3/1999 | Cayne | 482/130 |
| 5,931,768 | A | 8/1999 | Amesquita | 482/140 |
| 5,941,806 | A | 8/1999 | Olschansky et al. | 482/140 |
| 5,997,450 | A | 12/1999 | Wilkinson | 482/412 |
| 6,027,433 | A * | 2/2000 | Flynn | 482/98 |
| 6,086,521 | A | 7/2000 | Solland | 482/140 |
| 6,090,020 | A | 7/2000 | Webber | 482/100 |
| 6,117,057 | A | 9/2000 | Olschansky et al. | 482/140 |
| 6,244,991 | B1 * | 6/2001 | Bingham | 482/69 |
| 2002/0147087 | A1 * | 10/2002 | Tollner | 482/147 |
| 2004/0157711 | A1 * | 8/2004 | Regev | 482/142 |
| 2004/0198572 | A1 * | 10/2004 | Rouillard | 482/142 |
| 2005/0079957 | A1 * | 4/2005 | Bowman et al. | 482/51 |

* cited by examiner

*Primary Examiner*—Lori Amerson
(74) *Attorney, Agent, or Firm*—Cislo & Thomas, LLP

(57) ABSTRACT

An exercise device allowing a user to exercise his abdominal region by lying on his back while extending his arms generally upwards is disclosed. The device has a hand-gripping member positioned generally above the user's head for the user to grip while exercising. The hand-gripping member allows for a wide range of motion which may include side-to-side, front-to-back, diagonal, and/or rotational motion. This enables the user can exercise his abdominal region by moving in a variety of different directions, while keeping his arms extended.

15 Claims, 11 Drawing Sheets

ABDOMINAL EXERCISE DEVICE FOR INVERTED ABDOMINAL EXERCISES

CROSS-REFERENCE TO RELATED APPLICATIONS

This application claims the benefit of U.S. patent application Ser. No. 10/090,079, filed on Mar. 1, 2002, which is hereby incorporated by a reference.

BACKGROUND OF THE INVENTION

1. Field of the Invention

This invention relates generally to an abdominal exercise device and more particularly to an abdominal exercise device that utilizes one or more sliding motions for the purpose of exercising the abdominal muscles.

2. Description of the Related Art

Various exercising equipment and equipment free methods of exercising have been developed for exercising the abdominal muscles. Abdominal muscles are generally difficult to isolate and strengthen. Many hours and years of exercise are generally necessary to produce a significant effect on the abdominal musculature. Exercising these muscles may create strain and pressure on the back and neck muscles, depending on the technique used. Additionally, failure to maintain consistent and proper alignment while exercising the abdominal muscles may result an ineffective workout as well as injury.

SUMMARY OF THE INVENTION

An exercise device according to the present invention allows a user to exercise his abdominal region by lying on his back while extending the arms away from the body. The device has a hand-gripping member positioned generally above the user's head which the user grips while exercising. The force which the user exerts on the gripping element reduces the strain and pressure on the user's neck and back muscles, thus providing an isolated work out for mainly the abdominal muscles. The hand-gripping member allows for a wide range of motion which may include side-to-side, front-to-back, diagonal, and/or rotational motion. As such the user can exercise his abdominal region by moving in a variety of different directions, while keeping his arms extended. The device additionally provides the user with a technique of achieving proper and consistent alignment for achieving maximum results.

OBJECTS OF THE INVENTION

It is an object of the present invention to provide an exercise device for working mainly the abdominal muscles.

It is another object of the present invention to provide an exercise device for working mainly the abdominal muscles by enabling a user to move the upper body according to a wide range of motions.

It is yet another object of the present invention to provide an exercise device which allows the user to achieve maximum extension of the arms while exercising mainly the abdominal muscles.

These and other objects and advantages of the present invention will be apparent from a review of the following specification and accompanying drawings.

DESCRIPTION OF THE PREFERRED EMBODIMENT(S)

Figure 1:
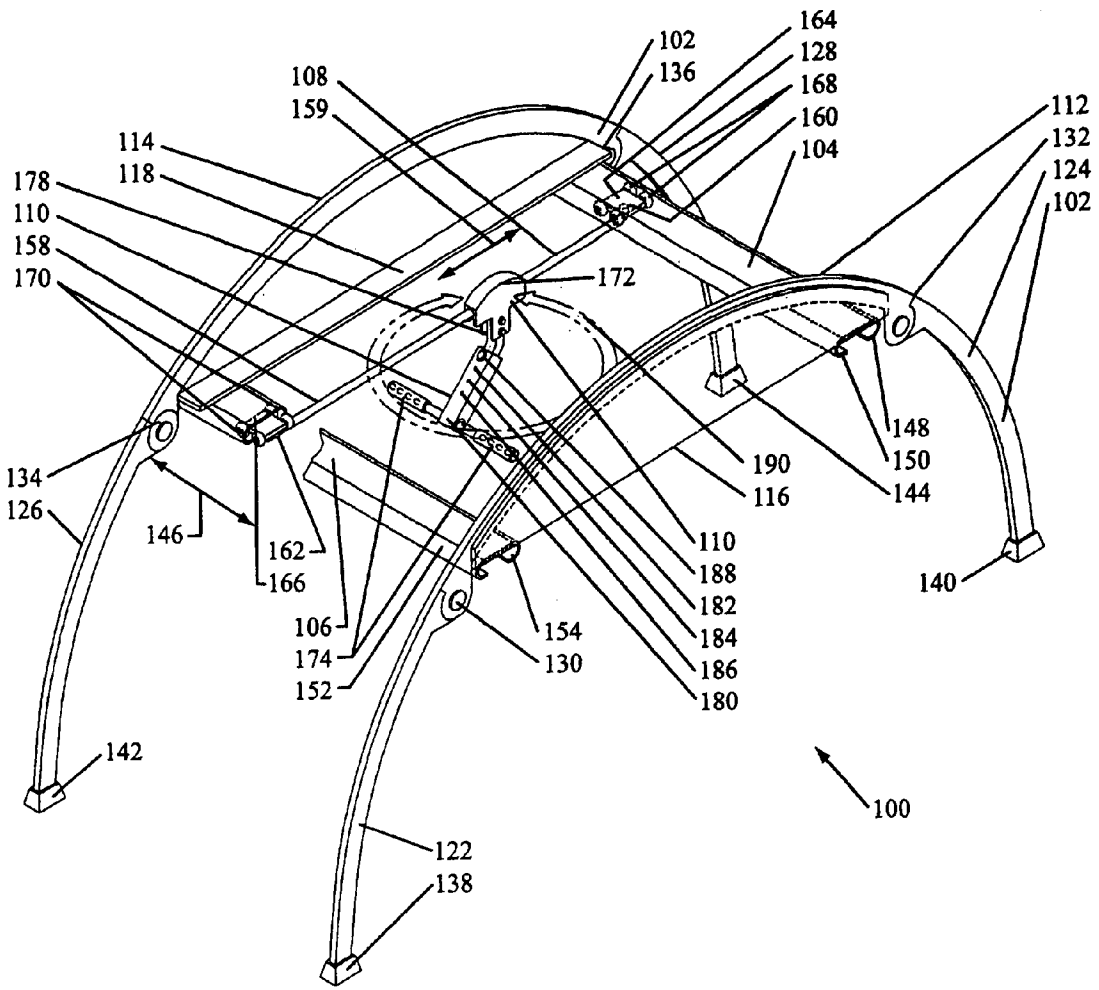
FIG. 1 is a perspective view of an abdominal- exercise device according to a first embodiment of the present invention.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

An exercise device according to the present invention allows a user to exercise his abdominal region by lying on his back while extending his arms generally upwards. The device has a hand-gripping member positioned generally above the user's head for the user to grip while exercising. The hand-gripping member allows for a wide range of motion which may include side-to-side, front-to-back, diagonal, and/or rotational motion. As such the user can exercise his abdominal region by moving in a variety of different directions, while keeping his arms extended.

FIGS. 1–4 illustrate an exercise device 100, for generally working the abdominal region, according to a first embodiment. The device 100 generally comprises a frame 102, first and second guiding members 104, 106 oppositely mounted on said frame 102, a third guiding member 108 slidably mounted on the first and second guiding members, and a hand-gripping member 110 slidably mounted on the third guiding member.

Figure 2:
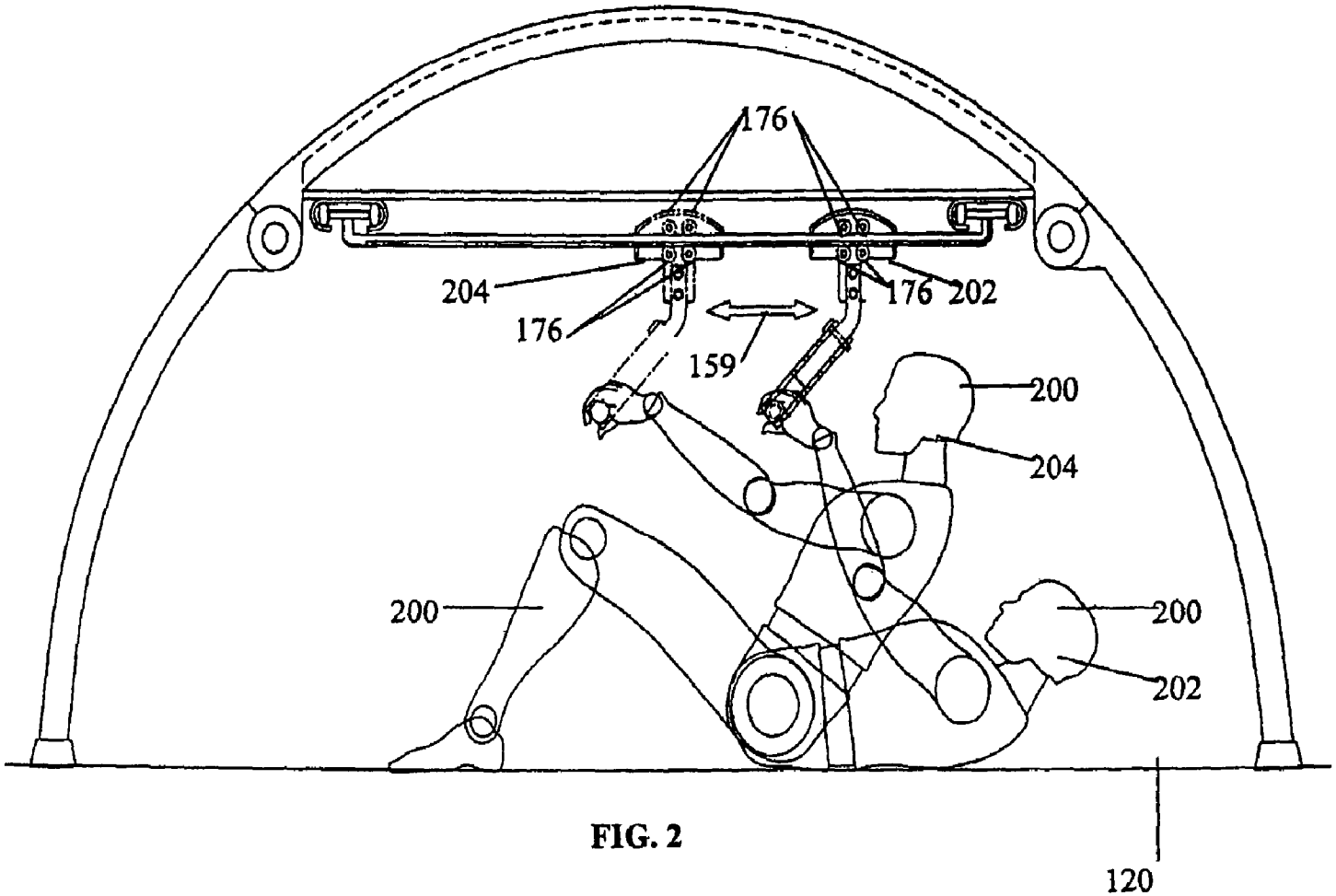
FIG. 2 is a side elevational view of the exercise device of FIG. 1, including a user exercising according to one method of exercise.

The frame 102 functions to provide a mounting for the guiding members and hand-gripping member, such that the hand-gripping member is positioned above the user's head while the device is freestanding on a surface 120. The frame includes support members, 112 and 114, for supporting an oppositely disposed pair of mounting members 116, 118 on which the first and second guiding members 104, 106 are mounted. The support members 112, 114 have leg members, 122, 124, 126, 128, such that the device is freestanding. The leg members 122, 124, 126, 128, may be made foldable, (e.g. via hinge joints, 130, 132, 134, 136, as shown in FIGS. 1 and 2) such that the device can be compacted for easier storage or transportation when not in use. The leg members 122, 124, 126, 128, may further include base elements, 138, 140, 142, and 144, as shown in the Figures.

The frame 102 is preferably metal, but may be made from any suitable rigid material. Although the frame, as illustrated in FIGS. 1 and 2, shows the support members 112, 114 as being arc shape, any suitable design for providing support to the mounting members 116, 118 may be used. For example, the frame may have straight legs extending perpendicularly downwards from the mounting members. Additionally, the mounting members 116, 118 may be secured to the supporting members, and the first and second guiding members may be secured to the mounting members, via any suitable method including bolting, welding, or a wedging or otherwise locking mechanism, or may form an integral unit therewith.

The first and second guiding members 104, 106 provide parallel tracks or rails on which the third guiding member 108 may freely slide side-to-side, as indicated by the arrow 146 in FIG. 1. According to a. preferred embodiment, the guiding members 104 and 106 each include brackets 148, 150, and 152, 154, respectively, disposed on a flat surface 156 and 158 of each guiding member for receiving rotating members disposed on the third guiding member 108. Although the brackets 148, 150, and 152, 154 are illustrated in the figures as oriented downwards with respect to the surfaces 156, 158, they may also be configured upwardly. Furthermore, the second guiding member 106 is shown broken in FIG. 1 for the purpose of illustration; however, it is to be understood that the member 106 is an unbroken, continuos piece.

The third guiding member 108 may comprise a bar 158 extending between the first and second guiding members, and rotating members 160, 162 disposed at either end of the bar for sliding along the brackets 148, 150, and 152, 154 of the first and second guiding members 104, 106. The rotating members 160, 162 may each comprise a surface 164 and 166, respectively, and a set of wheels 168 and 170, each set comprising two pairs of wheels, oppositely disposed across the respective surface 164 and 166, for sliding along the brackets 148, 150, and 152, 154 of the respective guiding member 104, 106.

Figure 3:
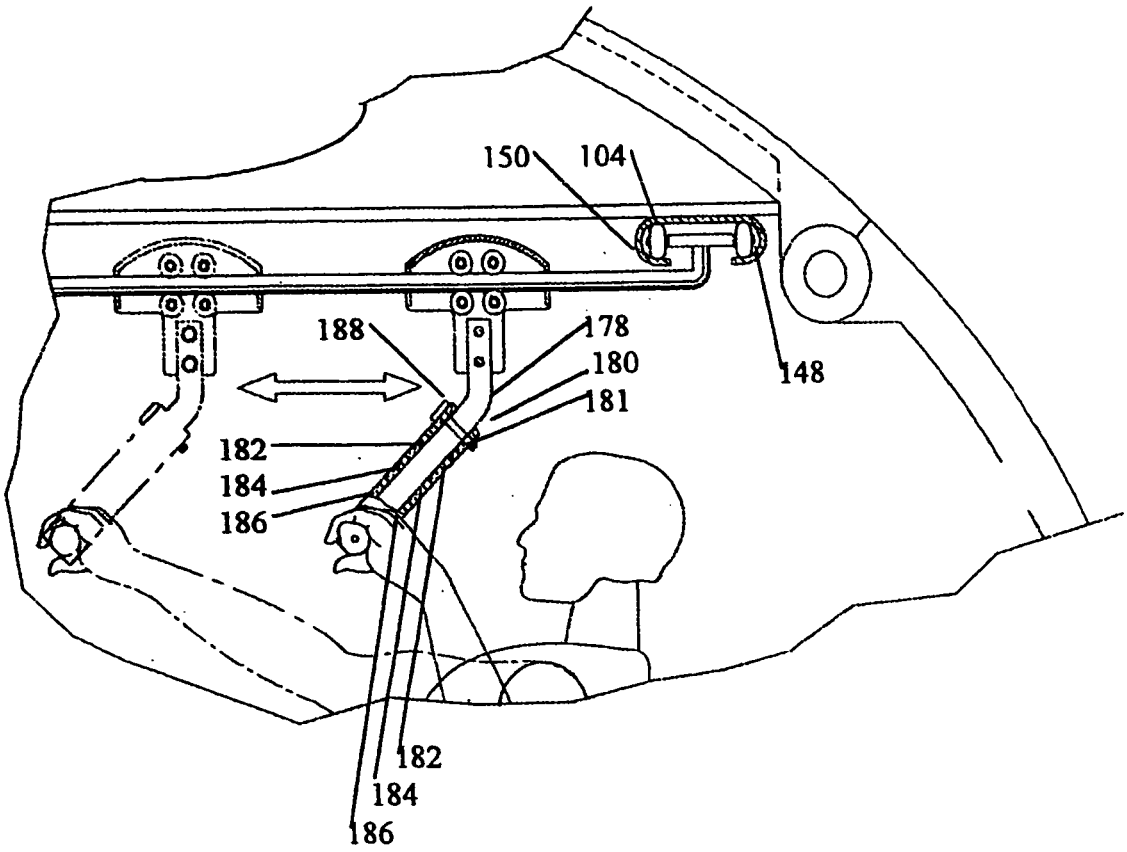
FIG. 3 is an enlarged sectional view of the third guiding member and hand-gripping member of the exercise device of FIG. 1.
Figure 4:
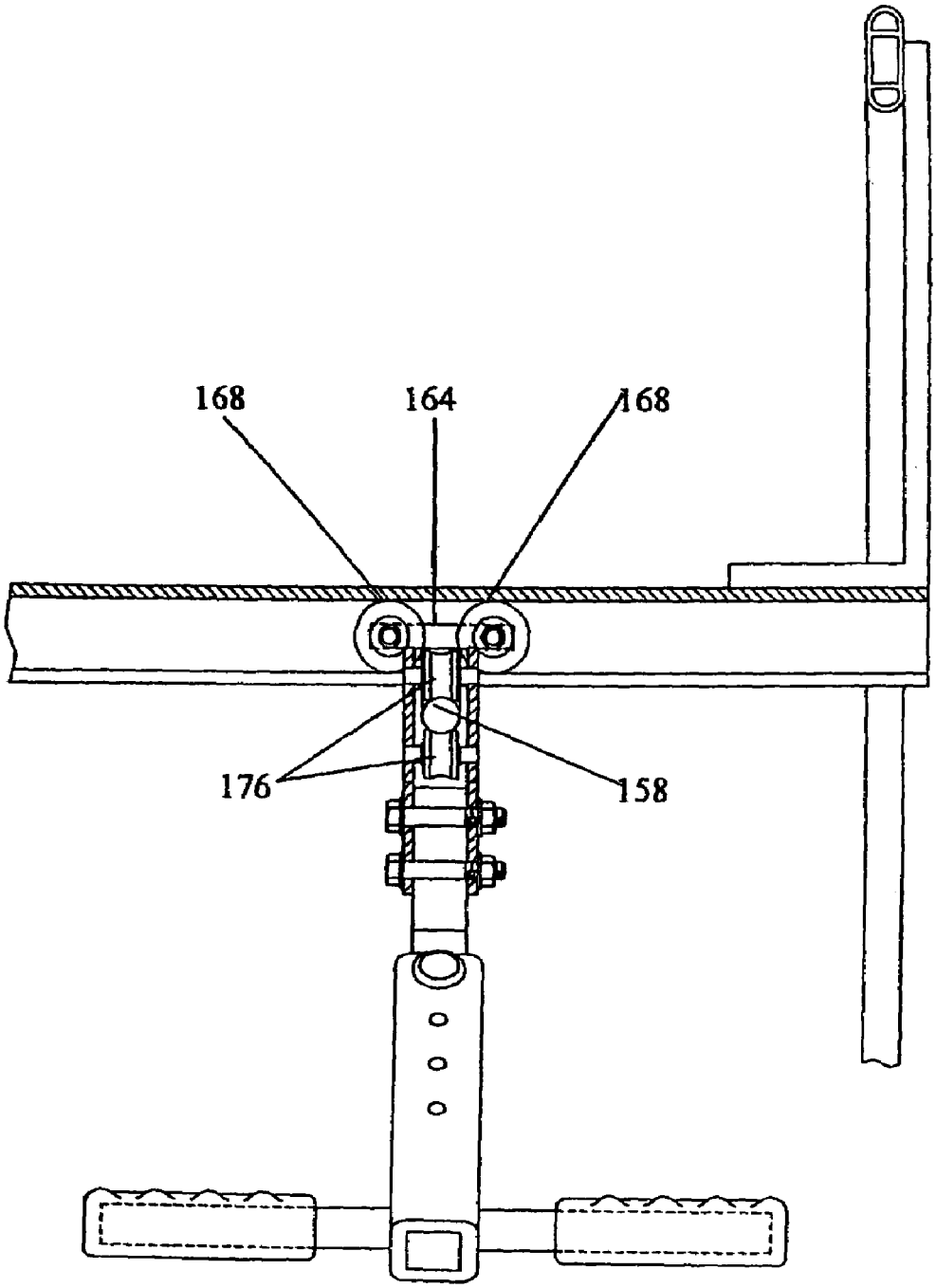
FIG. 4 is a front sectional view of the exercise device of FIG. 1.

The hand-gripping member 110 comprises a slidable member 172 coupled to an element which the user can grip, such as handles 174. As shown in FIGS. 2–4, the slidable member 172 may be made slidable on the bar 158 of the third guiding member 108, via wheels 176, which contact the bar 158 on top and bottom sides of the bar, such that the slidable member can slide front-to-back on the bar 158, as indicated by the arrow 159 in FIG. 1. (Alternate methods for providing slidable elements will be illustrated by alternate embodiments described herein).

As best illustrated in FIG. 3, the slidable member 172 may have a hollowed out portion for coupling the slidable member to the handles, by inserting a narrower connector piece 178 into the hollowed out portion, the hollowed out portion and connector piece having corresponding holes for bolting or screwing the pieces together. Additionally, the distance of the handles 174 from the surface 120 may be made adjustable by providing a hollowed rod 180 extending from the handles and having several locking holes 181, 182, 184, 186 for locking the handles into a corresponding hole of the connector piece via a locking pin 188.

As the hand-gripping member 110 can slide from side-to-side, and from front-to-back, curved or circular motion can be achieved (as indicated by the arrow 190 in FIG. 1), as well as diagonal motion.

FIG. 2 illustrate a user 200 exercising on the device 100 by moving his body from a first position 202, in which the user's upper body is positioned substantially flat against the surface 120, to a second position 204 in which the user's upper body is lifted forwards and up. (The device 100 is preferably smaller in scale with respect to the user's body then what is shown in the figure).

The user's hands extend to grip the handles 174 as the user exercise. The grip handles 174 move from the first position 202 to the second position 204 along with the user 200, such that the user's arms can remain extended at substantially the same length, as the user 200 moves. Thus the user's abdominal region is exercised while the arms can be kept fully extended away from the user's body. The force which the user exerts on the gripping element reduces the strain and pressure on the user's neck and back muscles, thus providing an isolated work out for mainly the abdominal muscles. Additionally, the user is guided through proper and consistent alignment while exercising.

While the user 200 is illustrated in FIG. 2 as moving his upper body in a front-to-back motion, many different exercise techniques are possible. For example, the user can move his raised upper body in a side-to-side motion, front-to-back motion, diagonal motion, or in a circular or semi-circular motion, or in a combination of different motions while keeping the arms fully extended.

An element for providing motion resistance to the hand-gripping member may be included. This may be accomplished by placing a weight on the hand-gripping member, or otherwise providing a friction-bearing element coupled to the hand gripping member, or coupling a spring or rubber band element between the frame and hand-gripping member.

Many different designs for providing a hand-gripping member capable of side-to side, front-to back, and/or rotational motion will be apparent to one skilled in the art. Methods for achieving the desired motion include providing a slidable attachment, spring mounting, pivot or ball attachment, or pendulum attachment coupled between the hand gripping member and frame. The following embodiments will illustrate examples of alternative designs for providing a hand-gripping element capable of the range of motions described herein. It should be understood that the invention is not limited to the examples provided.

Figure 5:
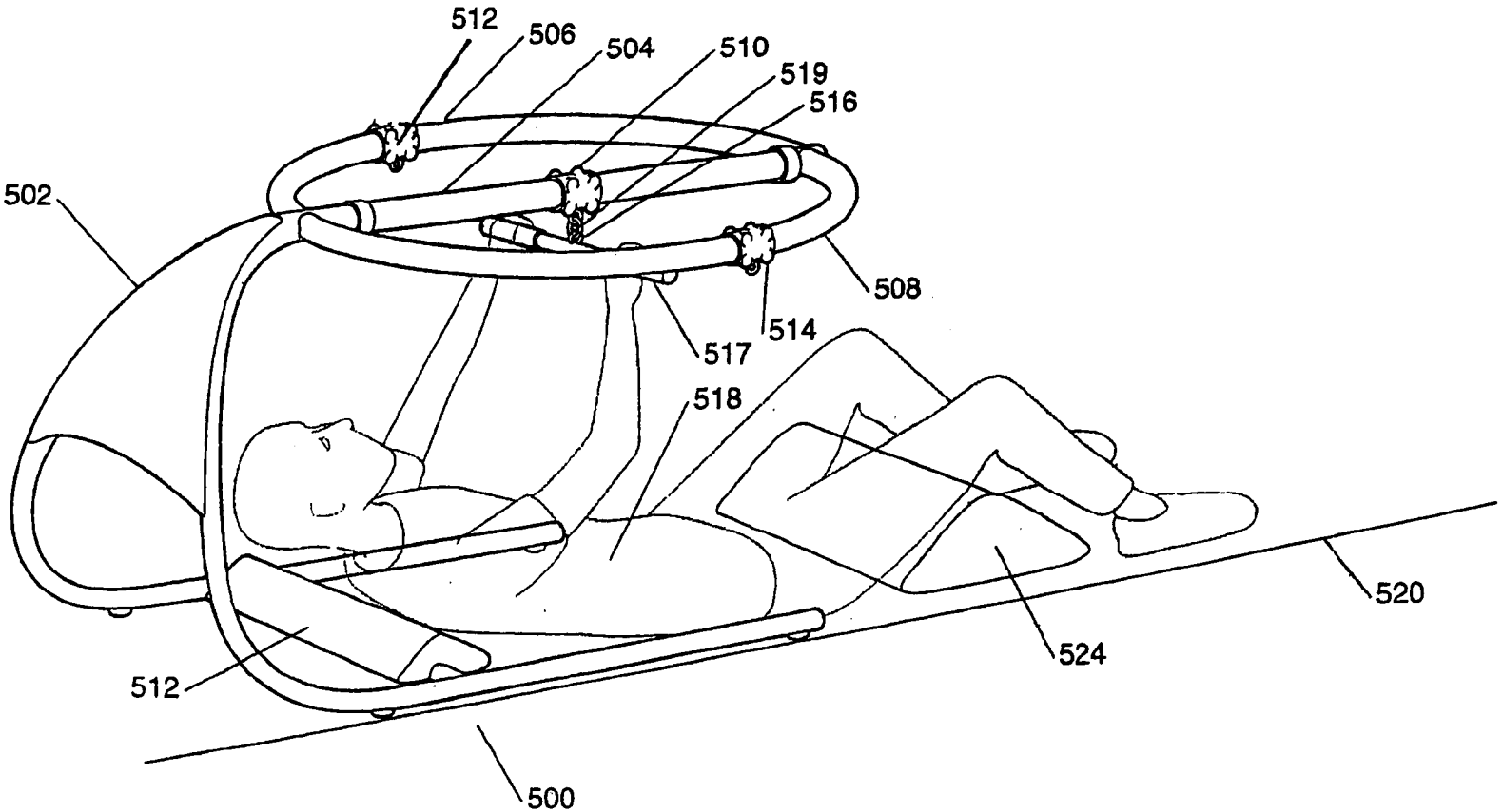
FIG. 5 is a perspective view of an abdominal exercise device according to a second embodiment of the present invention, including a user positioned on the device.

FIG. 5 illustrates an exercise device 500, according to a second embodiment. The device 500 generally comprises a frame 502 supporting guiding members comprising a central guiding member 504, and left and right guiding members 506, 508. The device 500 further comprises slidable members 510, 512, and 514 coupled to the guiding members 504, 506, and 508, respectively, for sliding on the guiding members. A hand-gripping member 516 comprising handles 517 and a chain 519 may be coupled to any one of the slidable members 510, 512, or 514. A hook or any other attachment mechanism can be provided for attaching the chain 519 to the slidable members.

As shown in the figure, the left and right guiding members 506 and 508 may each be semi circular units, forming a continuous circular unit integral with the frame. The central guiding member 504 forms a bar or rod through the center of the circle formed by the left and right guiding members 506, 508.

The slidable members 510, 512, and 514 and guiding members 504, 506, and 508 may each have a smooth surface providing nearly frictionless contact between each guiding member and corresponding slidable member. The surfaces may comprise Teflon, plastic, metal, or other smooth material.

A user 518 of the device 500 is positioned for exercise by lying on a surface 520, with his hands gripping the handles 517 of the hand-gripping member 516. As shown in the figure, cushions for supporting the user on the surface 520 may be provided, including a head cushion 522, which may be coupled to the frame as shown, and a leg cushion 524.

By having the hand-gripping member 516 coupled to the slidable member 510 of the central guiding member 504, the user 518 may exercise his abdominal region using a front-to-back motion, while keeping his hands extended on the handles 517. The user can similarly exercise by moving his upper body in a semi-circular front-to-back motion by having the hand-gripping member 516 coupled to the one of the slidable members of the left or right guiding members 506 or 508.

Having a relatively short chain 519, as illustrated -in the figure, effectively confines the available patterns of motion to a two-dimensional plane, substantially parallel to the guiding members 504, 506, 508. By increasing the length of the chain 519, the user can also utilize pendulum motion for other ranges of motion. Such motion may include swing motion which may be side-to-side, front-to-back, diagonal or a combination thereof, or fully circular motion (which is also confined to a plane parallel to the guiding members).

Figure 6:
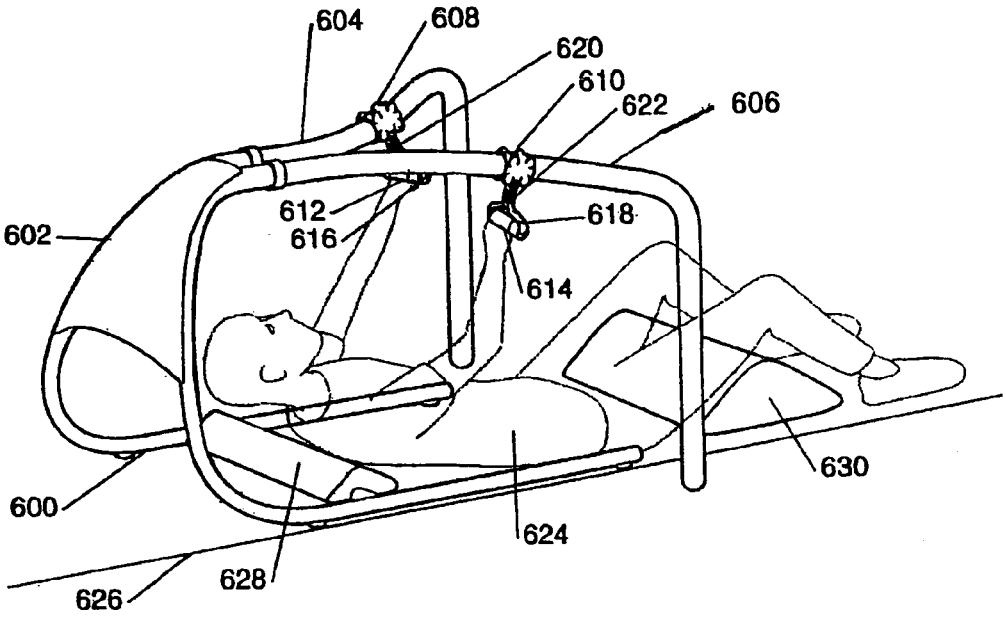
FIG. 6 is a perspective view of an abdominal exercise device according to a third embodiment of the present invention, including a user positioned on the device.

FIG. 6 illustrates an exercise device 600, according to a third embodiment. The device 600 generally comprises a frame 602 supporting left and right guiding members 604, 606. The device 600 further comprises slidable members 608 and 610 coupled to the guiding members 604 and 606, respectively, for sliding on the guiding members. Left and right hand-gripping member 612 and 614 comprising a left and a right handle 616 and 618, and corresponding chains 620 and 622, respectively, may be coupled to the slidable members 608 and 610. A hook or any other attachment mechanism can be provided for attaching the chains 620, 622 to the slidable members.

As shown in the figure, the left and right guiding members 606, 606 together form a "V" shape integral with the frame. Similar to the device 500, the slidable members 608 and 610 and guiding members 604 and 606 may each have a smooth surface providing nearly frictionless contact between each guiding member and corresponding slidable member. The surfaces may comprise Teflon, plastic, metal, or other smooth material.

A user 624 of the device 600 is positioned for exercise by lying on a surface 626, with his left and right hands gripping respective handle 616 and 618. Cushions for supporting the user on the surface 626 may be provided, including a head cushion 628, which may be coupled to the frame as shown, and a leg cushion 630.

The user 624 may exercise his abdominal region using a front-to-back motion, while gripping one of the handles 616, 618 in each hand and tracing along a "V" pattern as the user moves back and forth. A single hand-gripping unit having handles on which the user can grip with both hands can replace either the left or right handle, such that the user can exercise by moving in a left or right front-to-back motion.

Figure 7:
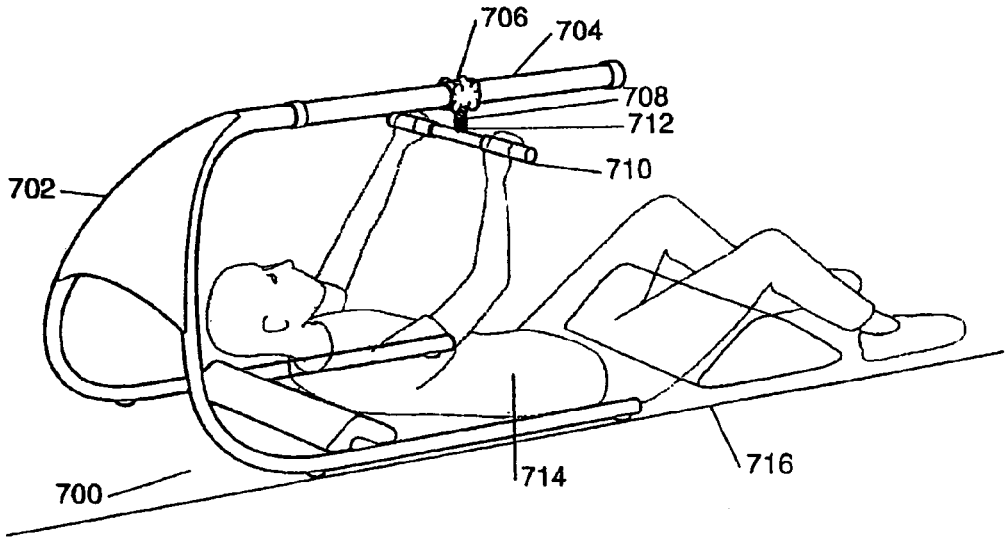
FIG. 7 is a perspective view of an abdominal exercise device according to a forth embodiment of the present invention, including a user positioned on the device.

FIG. 7 illustrates an exercise device 700, according to a forth embodiment. The device 700 generally comprises a frame 702 supporting a centrally extending guiding member 704. The device 700 further comprises a slidable member 706 coupled to the guiding member 704, for sliding on the guiding member. A hand-gripping member 708 comprising handles 710 and a chain 712 may be coupled to the slidable member 706. A hook or any other attachment mechanism can be provided for attaching the chain 712 to the slidable member.

Similar to the devices 500 and 600, the slidable member 706 and guiding member 704 may each have a smooth surface providing nearly frictionless contact between them. The surfaces may comprise Teflon, plastic, metal, or other smooth material.

A user 714 of the device 700 is positioned for exercise by lying on a surface 716, with his hands gripping the handles 710. Cushions for supporting the user on the surface 716 may be provided as shown in the figure. The user 714 may exercise his abdominal region using a front-to-back motion, while gripping the handles 710 to keep his. hands fully extended while moving back and forth.

Figure 8:
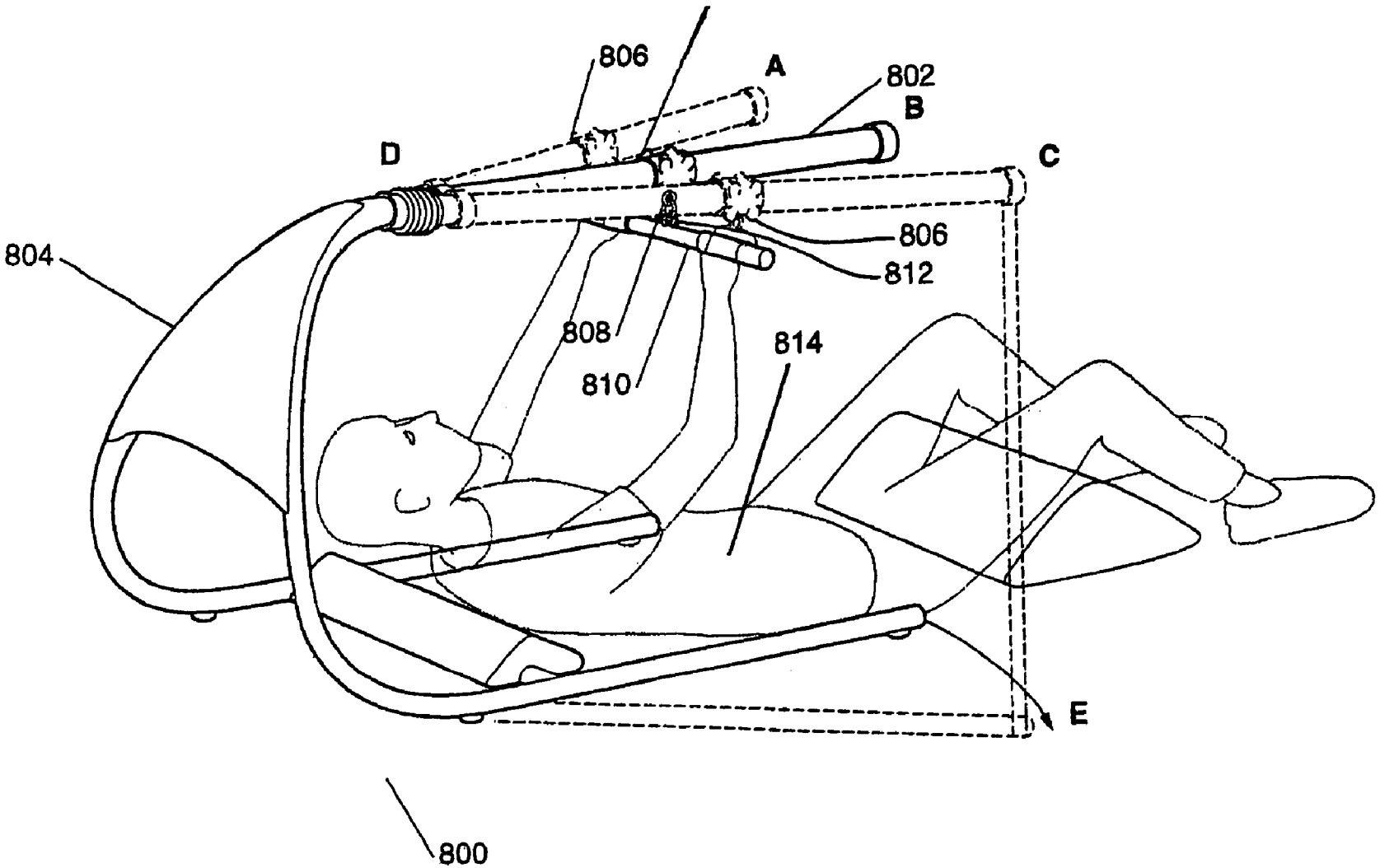
FIG. 8 is a perspective view of an abdominal exercise device according to a fifth embodiment of the present invention, including a user exercising on the device.

FIG. 8 illustrates an exercise devise 800, according to a fifth embodiment. The device 800 is similar to the device 700 of the forth embodiment, except for having a guiding member 802 capable of side-to-side motion via a spring joint mechanism attached to the frame 804, as shown in the figure. (Although not illustrated in the figure, a spring or ball attachment may also be provided for enabling up-and-down and/or rotational movement of the guiding member 802).

As in the device 700, the device 800 also has a slidable member 806 for sliding on the guiding member 802, and a hand-gripping member 808 comprising handles 810 and a chain 812.

A user 814 positioned on the device 800 may exercise his abdominal region using a front-to-back motion, while gripping the handles 810 to keep his hands fully extended while moving back and forth. The user may further cause the guiding member to move side-to-side. Thus, the user can exercise by moving side-to-side, font-to-back, or by combining both side-to-side and front-to-back motion to achieve diagonal, circular, or partially circular motion.

Figure 9:
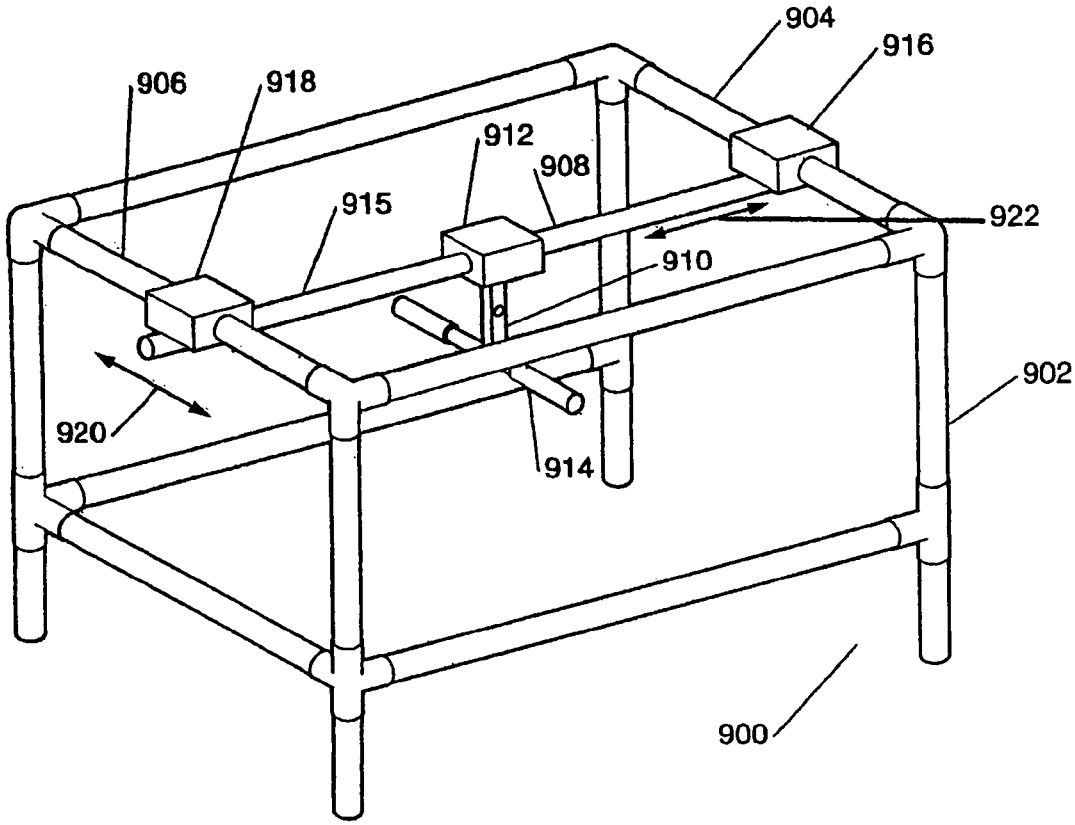
FIG. 9 is a perspective view of an abdominal exercise device according to a sixth embodiment of the present invention.

FIG. 9 illustrates an exercise device 900, according to a sixth embodiment. The device 900 is similar to the device 100 of the first embodiment, in that it generally comprises a frame 902, first and second guiding members 904, 906 oppositely mounted on said frame 902, a third guiding member 908 slidably mounted on the first and second guiding members, and a hand-gripping member 910 slidably mounted on the third guiding member. The hand-gripping member 910 comprises a slidable member 912 and handles 914 which a user can grip.

The first and second guiding members 904, 906 may comprise rails or bars on which the third guiding member 908 may slide. The third guiding member 908 comprises a bar 915 having first and second slidable members 916, 918 on its opposite ends, contacting the first and second guiding members 904, 906, such that the third guiding member 908 may slide from side-to-side, as indicated by the arrow 920.

The slidable members 916, 918 of the third guiding member 908 may be made slidable by providing wheels rotatively guided on the first and second guiding members 904, 906, or by providing smoothly surfaced materials for the slidable members 916, 918 and first and second guiding members 904, 906, such that the slidable members 916, 918, and first and second guiding members 904, 906 are in nearly frictionless contact.

The slidable member 912 of the hand gripping member 910 may similarly be made slidable on the bar 915 of the third guiding member, for moving from front-to-back, as indicated by the arrow 922. Thus, a user can exercise his abdominal region by utilizing front-to-back, side-to-side, diagonal, or circular motion, or a combination thereof, while keeping his arms extended.

Figure 10:
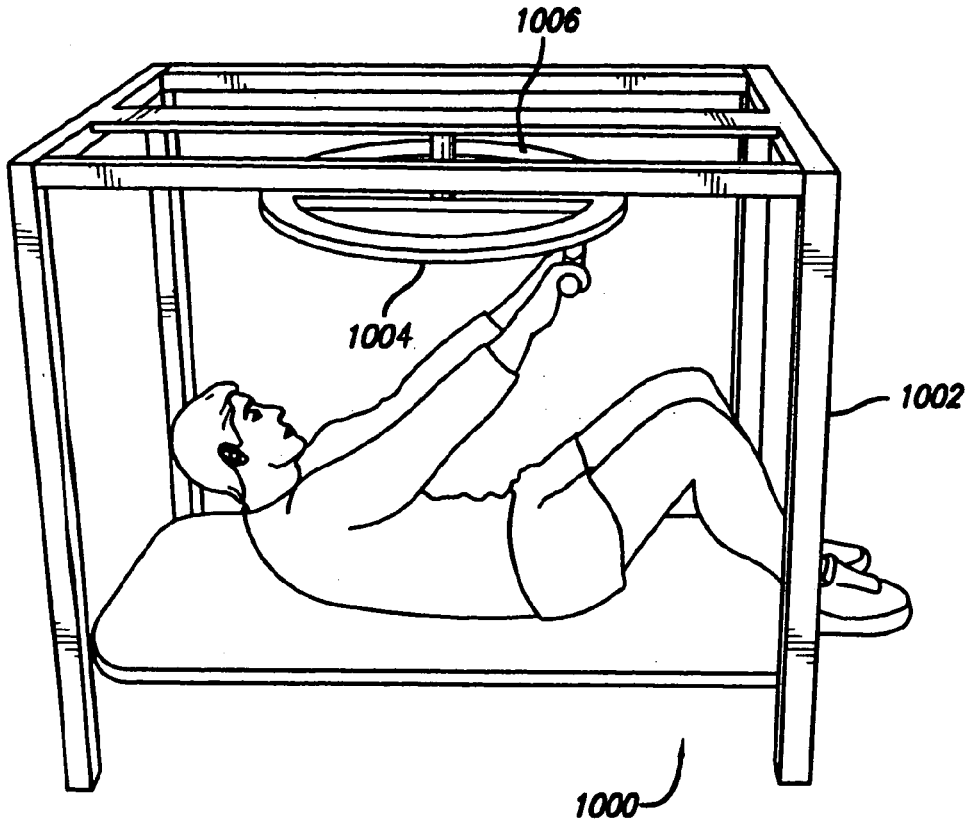
FIG. 10 is a perspective view of an abdominal exercise device according to a seventh embodiment of the present invention, including a user exercising on the device.

FIG. 10 illustrates an exercise device 1000, according to a seventh embodiment, which is similar to the device 500 of the second embodiment, providing an alternate structure for the frame 1002 and circular guiding members 1004, 1006.

Figure 11:
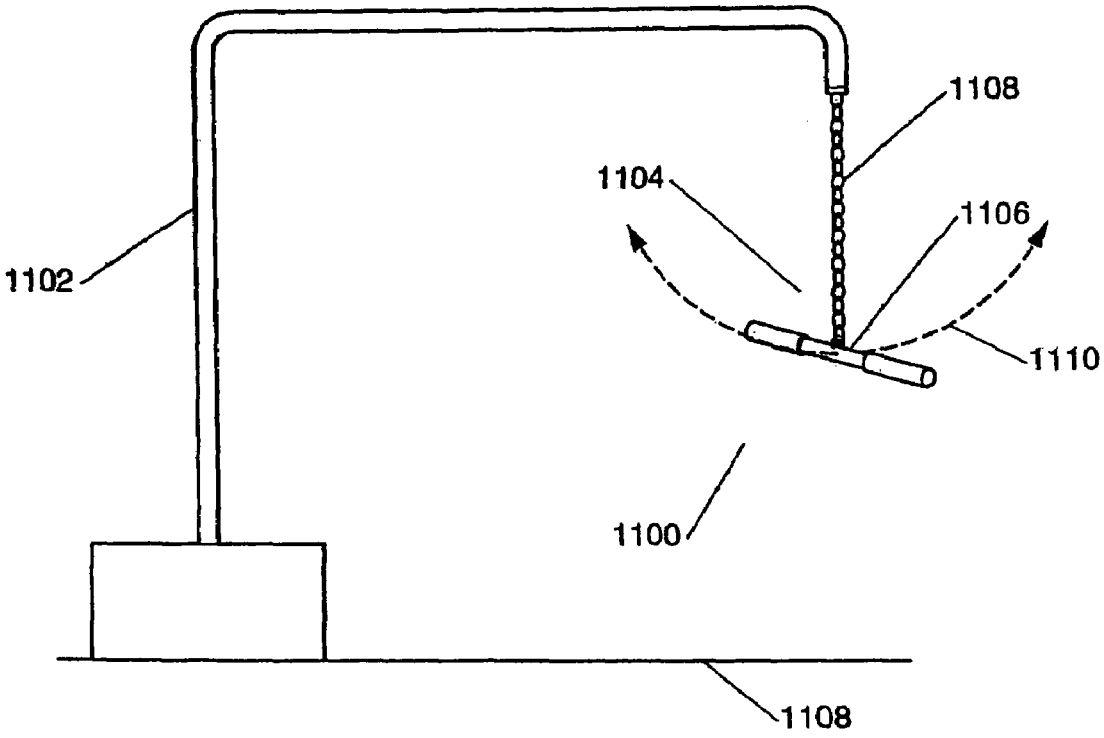
FIG. 11 is a perspective view of an abdominal exercise device according to an eighth embodiment of the present invention.

FIG. 11 illustrates an exercise device 1100, according to an eighth embodiment, comprising a frame 1102 supporting a hand-gripping member 1104 which includes handles 1106 mounted on a long chain 1108. A user can exercise his abdominal region by laying on the surface 1108 with his hands extending to grip the handles 1106, and utilize pendulum or swing motion of the hand gripping member 1104 to move his upper body according to a back-and-forth swing (indicated by the arrow 1110), side-to-side swing, or circular motion.

Figure 12:
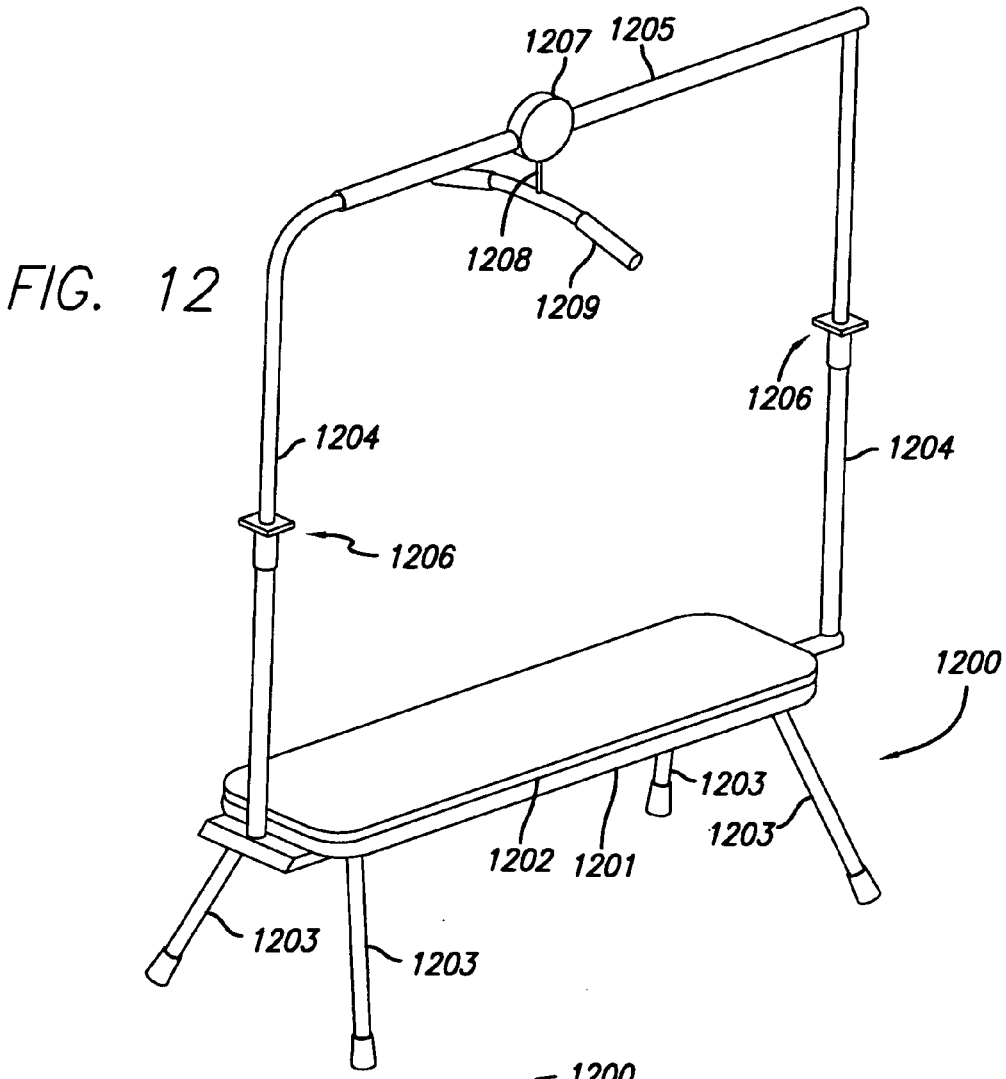
FIG. 12 is a perspective view of an abdominal exercise device according to a ninth embodiment of the present invention.
Figure 13:
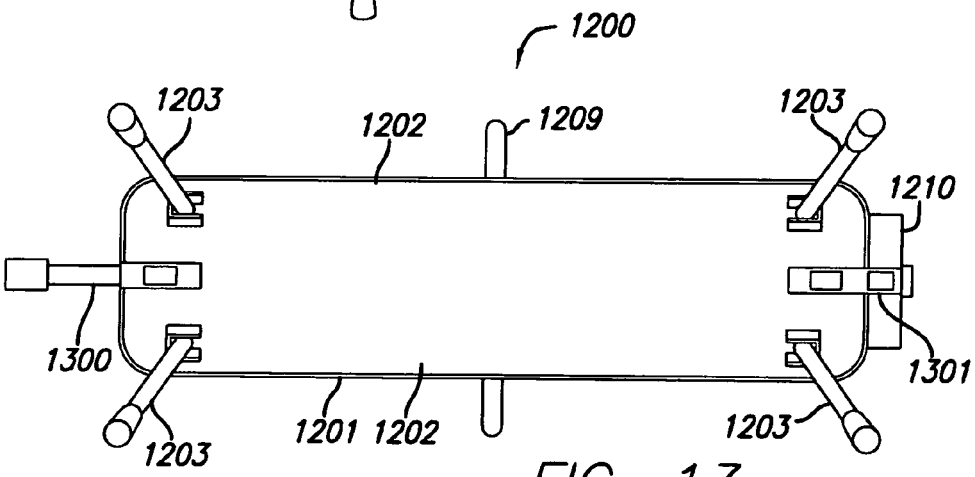
FIG. 13 is a bottom view of the embodiment depicted in FIG. 12.

FIG. 12 illustrates an exercise device 1200 according to a ninth embodiment, comprising a bench 1201, a frame 1204, 1205 having a handle 1209 slidably movable along the frame member 1205. The bench is a generally rectangular structure as depicted in FIG. 12, but as those skilled in the art will appreciate, the bench 1201 may have a plurality of shapes known or developed in the art. The bench 1201 also includes frame members 1202 that are coupled to the edge of the bench. In other embodiments, the bench 1201 may not include the frame rail members 1202. The bench 1201 also includes a plurality of legs 1203 that are coupled to the bottom of the bench 1201. According to one embodiment, the legs 1203 may be foldable. In another embodiment, the legs may be fixed to the bottom of the bench 1201. As shown in FIG. 12, the legs 1203 are splayed to provide additional stability for the bench. In other embodiments, the legs 1203 may be substantially perpendicular to the surface of the bench 1201.

The exercise device 1200 also includes a frame that is comprised of a plurality of members 1204, 1205. The members 1204, 1205 form a generally U-shaped structure that is securable to the bench 1201. According to one embodiment, the frame members 1204,1205 may be individual members that are coupled together. In another embodiment, the frame elements 1204, 1205 may be a unitary structure. As shown in FIG. 12, the frame members 1204,1205 have a generally circular cross section. In other embodiments, the frame members may have a square or rectangular cross section. The vertical members 1204 include an adjustment means 1206 that allows the height of the vertical member 1204 to be adjusted. That is, the horizontal bar 1205 may be raised or lowered by manipulating the adjustment means 1206. The frame is configured such that the horizontal bar 1205 is generally parallel to the surface of the bench 1201.

The horizontal bar 1205 includes a slideable member 1207 that may move along the length of the horizontal member 1205. A hand-gripping member 1209 may be coupled to the slidable member 1207 via a coupling means 1208. According to one embodiment, the coupling means 1208 may be a rope, chain, cable, or the like. As shown in FIG. 12, the hand-gripping member 1209, is slightly bent at the ends and includes handgrips that are at the ends of the hand-gripping member 1209. In other embodiments, the hand-gripping member 1209 may be a generally straight rod and may or may not include handgrips.

The U-shaped frame member may be coupled to the bench by a plurality of means. According to one embodiment, the U-shaped member may be directly affixed to the ends of the bench 1201. In other embodiments, the frame may be coupled to the bench 1201 by a bracket 1210. In yet another embodiment, the frame may be coupled to the bench 1201 via a combination of brackets and additional tubing. As shown in FIG. 12, the horizontal frame members 1204 are generally perpendicular to the surface of the bench 1201. In other embodiments, the frame may be rotatably coupled to the bench surface such that the frame and the horizontal members 1204 may be adjusted between an angle of approximately zero degrees to 180 degrees relative to the bench surface.

While the present invention has been described with regards to particular embodiments, it is recognized that additional variations of the present invention may be devised without departing from the inventive concept.

What is claimed is:

1. An abdominal exercise device, comprising:

a bench dimensioned to support a user's body during an adnominal or related exercise;

an inverted U-shaped frame rotatably coupled to the bench and rotatable about an axis that is generally parallel to and located along or below the user's body when said user is lying underneath said hand-gripping member during said exercise, wherein the frame comprises at least one vertical member coupled to a horizontal frame member, wherein the horizontal frame member is generally parallel to the bench; and a hand-gripping assembly slideably coupled to the horizontal frame member and shaped and dimensioned to be gripped by the user's hands during said exercise, wherein, with the user lying on his back on the bench and gripping the hand-gripping member with his hands, repeated sliding of the hand-gripping member along the horizontal frame member causes the user to perform abdominal crunches or related muscular exercises.

2. The exercise device of claim 1 wherein the bench further comprises a plurality of legs coupled to a bottom of the bench, said legs being collapsible so that when the legs are collapsed and when the frame is rotated to a position generally parallel to the bench, the exercise device has a storage profile of approximately the thickness of the bench.

3. An abdominal exercise device, comprising:

a bench having a top and a bottom, wherein a plurality of legs coupled to the bottom of the bench and wherein the top of the bench is shaped and dimensioned to support a user's body during abdominal muscle and related muscle exercises;

a frame rotatably coupled to the bench and rotatable about an axis that is generally parallel to and located along or below the user's body when said user is lying underneath said hand-gripping member during said exercises, the frame comprising a first frame member coupled to a first end of the bench, a second frame member coupled to a second end of the bench, and a horizontal frame member coupled to the first frame member and the second frame member; and a hand-gripping assembly slideably coupled to the horizontal frame member and positioned to be gripped by the user's hands and repeatedly slid along the horizontal frame member to effectuate abdominal crunches and related exercises.

4. The exercise device of claim 3 wherein the plurality of legs are collapsible so that when the legs are collapsed and when the frame is rotated to a position generally parallel to the bench, the exercise device has thin overall storage profile for storage under a bed, sofa, or in a similarly narrow space.

5. An abdominal exercise device, comprising:

a bench having a top and a bottom, wherein a plurality of legs coupled to the bottom of the bench and wherein the top of the bench is shaped and dimensioned to support a user's body during abdominal muscle and related muscle exercises;

a frame rotatably coupled to the bench and rotatable about an axis that is generally parallel to and located along or below the user's body when said user is lying underneath said hand-gripping member during said exercises, the frame comprising a first frame member coupled to a first end of the bench, a second frame member coupled to a second end of the bench, and a horizontal frame member coupled to the first frame member and the second frame member, wherein the first and second frame members include an adjustment means for vertically positioning said horizontal frame member at an appropriate distance from the user's body during said exercises so that the user's arms remain extended while performing the exercises; and a hand-gripping assembly slideably coupled to the horizontal frame member and shaped and dimensioned to be gripped by the user's hands and repeatedly slid along the horizontal frame member to effectuate abdominal crunches and related exercises, wherein the hand-gripping assembly comprises a slideable member slideably coupled to the horizontal frame member and a coupling means securing a hand-gripping member to the slideable member.

6. The exercise device of claim 5 wherein the plurality of legs are collapsible so that when the legs are collapsed and when the frame is rotated to a position generally parallel to and located along or below the bench, the exercise device has thin overall storage profile for storage under a bed, sofa, or in a similarly narrow space.

7. An abdominal exercise device, comprising:

a hand-gripping member shaped and dimensioned to be gripped by a user's hands, said hand-gripping member being positioned generally above a user's head when the user lies on his back, said hand-gripping member further being capable of side-to side motion, front-to-back motion, diagonal motion, rotational motion about an axis that is generally parallel to the user's body when said user is lying underneath said hand-gripping member during an exercise, or a combination thereof, relative to the user, said motion when repeated causing the user to perform exercises on his or her abdominal muscles.

8. The device of claim 7 wherein the user exercises by moving his upper body from a first position to a second position, the user's arms being kept extended while gripping the hand-gripping member, wherein in said second position the user's body is raised relative to said first position.

9. The device of claim 7 wherein the user exercises by moving his upper body in a side-to-side motion, front-to-back motion, diagonal motion, rotational motion, or a combination thereof, the user's arms being kept extended while gripping the hand-gripping member.

10. An abdominal exercise device, comprising:

a frame comprising a bench having a top surface shaped and dimensioned to support a user's body during abdominal muscle and related muscle exercises, and a movable hand-gripping member mounted on said frame shaped and dimensioned to be gripped by a user's hands, said hand-gripping member being positioned generally above a user's head when the user exercises on the device, said hand gripping member further being capable of side-to-side motion, front-to-back motion, diagonal motion, rotational motion about an axis that is generally parallel to and located along or below the user's body when lying underneath said hand-gripping member during said exercises, or a combination thereof, relative to the user, while the frame remains stationary, wherein the user exercises by repeatedly moving his upper body in a side-to-side motion, front-to-back motion, diagonal motion, rotational motion, or a combination thereof, the user's arms being kept extended while gripping the hand-gripping member thereby causing the user to perform exercises on his or her abdominal muscles.

11. The device of claim 10, further comprising:

first and second guiding members oppositely mounted on said frame, and a third guiding member slideably mounted on said first and second guiding members, and having opposite first and second ends supported on said first and second guiding members respectively, wherein said hand-gripping member is slideably mounted on said third guiding member.

12. A method of exercise for a person's abdominals or related muscles comprising:

lying on one's back on a substantially flat surface facing up, gripping handles positioned above the person's head, said handles being suspended from an inverted frame, said handles further being capable of sliding along said frame to produce front-to-back, side-to-side, diagonal, rotational motion about an axis that is generally parallel to and located along or below the user's body when lying underneath said hand-gripping member during an exercise, or a combination thereof, and repeatedly sliding said handles along said frame thereby moving the upper body according to a pattern comprising front-to-back, side-to-side, diagonal, rotational motion, or a combination thereof to effectuate abdominal crunches or related muscular exercises.

13. The method of claim 12 wherein the arms are kept extended at substantially the same length while exercising.

14. The method of claim 12 wherein said motion of said gripping handles is substantially confined to a plane generally parallel to said surface.

15. An abdominal exercise device, comprising:

means for supporting a user's body during the performance of abdominal crunches or related muscular exercises, and means for gripping a portion of said device with the user's hands mounted on said support means, said hand-gripping means being positioned generally above the user's head when the user lies on his back, said hand-gripping means further comprising means for movement including side-to-side, front-to-back, diagonal, or rotational movement about an axis that is generally parallel to and located along or below the user's body when the user is lying underneath said hand-gripping means during an exercise, or a combination thereof, the user's arms being kept extended while gripping the hand-gripping means during said abdominal crunches or related muscular exercises.

* * * * *